US005385641A

United States Patent [19]

Berg et al.

[11] Patent Number: 5,385,641

[45] Date of Patent: Jan. 31, 1995

[54] DELIGNIFICATION OF CELLULOSIC RAW MATERIALS USING ACETIC ACID, NITRIC ACID AND OZONE

[75] Inventors: Alex Berg, Schwäbisch-Hall; Wim Janssen, Murrhardt; Stefan Ballé, Schwäbisch Gmund; Rudolf G. Kunz, deceased, late of Nürtingen, by Eberhard C. Kunz, executor; Wolfdieter Klein, Recklinghausen, all of Germany

[73] Assignee: Acetocell GmbH & Co. KG, Gschwend, Germany

[21] Appl. No.: 848,132

[22] Filed: Mar. 9, 1992

[30] Foreign Application Priority Data

Mar. 8, 1991 [DE] Germany ..... 4107354

[51] Int. Cl.[6] ..... D21C 3/20

[52] U.S. Cl. ..... 162/76; 162/65; 162/78; 162/81

[58] Field of Search ..... 162/65 B, 76, 78, 81, 162/19

[56] References Cited

U.S. PATENT DOCUMENTS

| | | | |
|---|---|---|---|
| 2,511,096 | 6/1950 | Bate et al. | 92/9 |
| 4,100,341 | 7/1978 | Brasey et al. | 162/81 |
| 4,283,251 | 8/1981 | Singh | 162/65 B |
| 4,897,156 | 1/1990 | Samuelson | 162/81 |
| 5,074,960 | 12/1991 | Nimz et al. | 162/65 |

FOREIGN PATENT DOCUMENTS

| | | |
|---|---|---|
| 83396 | 6/1920 | Austria . |
| 0325890 | 2/1989 | European Pat. Off. . |
| 3445132 | 6/1986 | Germany . |
| 474305 | 11/1937 | United Kingdom . |

OTHER PUBLICATIONS

Patt, R., "Application of Nitrogen Dioxide and Ozone in the Pre-Bleaching of Kraft & Sulfite Pulps", 1985 Int'l Pulp Bleaching Conference, pp. 37–44.

Lachenal, D. "Improvement of Ozone Prebleaching of Kraft Pulps", Journal of P&P Science, vol. 12, No. 2, Mar. 1986, pp. 50–52.

"Production of Bleached Pulp in the Future", Int. Pulp. Ble. Conf., SPCI, vol. 3.

James Casey, "Pulp & Paper", vol. I, 2nd edition, 1960, p. 457.

Mbachu, R. A. D. et al.: "The Effect of Acetic and Formic Acid Pretreatment on Pulp Bleaching with Ozone" in the U.S. Book: TAPPI, 1981, vol. 64, No. 1, pp. 67–70.

Nimz, H. H. et al.: "Pulp Production and Bleaching According to the Acetosolv Method" in the German Periodical Das Papier, 1989, Issue 10A, pp. V 102 to V 108.

Wang, D. L.-K. et al.: "Delignification of Spruce and Beech Sulfite Pulps with the Use of Ozone" in the German Periodical Das Papier, 1984 Issue 6, pp. 245–254.

Papier Das, vol. 43; No. 10A; Oct., 1989; H. Nimz, et al.; pp. 102–108.

*Primary Examiner*—W. Gary Jones
*Assistant Examiner*—Dean T. Nguyen
*Attorney, Agent, or Firm*—Antonelli, Terry, Stout & Kraus

[57] ABSTRACT

In a three-stage process for the delignification of cellulose-containing raw materials, pulping is initially performed with a solution of concentrated aqueous acetic acid at an elevated temperature and under an elevated pressure. The resultant acetic acid-moist pulp is treated in a second stage with the aforementioned pulping solution with the addition of nitric acid and is then washed or extracted with water or with the pulping solution. In a third treatment stage, the thus-obtained acetic acid-moist pulp is treated with an ozone-containing gas.

7 Claims, No Drawings

DELIGNIFICATION OF CELLULOSIC RAW MATERIALS USING ACETIC ACID, NITRIC ACID AND OZONE

BACKGROUND OF THE INVENTION

This invention relates to a process for the delignification of cellulose-containing; namely, lignocellulose-containing raw materials with a pulping solution of concentrated aqueous monocarboxylic acid, acetic acid, at increased temperature and under elevated pressure.

The classical processes utilized on a large industrial scale for obtaining pulp from the typical raw materials, namely suitable hardwoods or softwoods, annual or perennial fibrous plants, such as, for example, bagasse, reed or *Miscanthus sinensis*, as well as cereal straw, are the sulfite process and the sulfate process. The pulping liquors utilized in these methods exhibit well-known drawbacks with respect to the inherent pollution. These drawbacks are, on the one hand, the use of sulfur-containing pulping compounds and the problematic exploitation of the resultant sulfur-containing waste liquors which include the separated lignin and on the other hand, the use of chlorine-containing bleaching agents which are not harmless, either.

A course deviating from the sulfite process or the sulfate process was followed with processes utilizing organic solvents in place of the polluting inorganic chemicals as the pulping agents. Acetic acid, in particular, proved to be advantageous in this respect. The prior art includes pressure-less processes for obtaining cellulose pulp from lignocellulosic starting materials by means of acetic acid in the presence of catalytically acting amounts of mineral acids, as well as non-catalytic processes for the manufacture of cellulose from lignocellulosic materials by means of acetic acid, as described in U.S. Pat. No. 3,553,076 according to which temperatures are employed on the order of 150° to 205° C. Under optimal conditions, it is possible by means of these methods, for example with softwood as the starting material, to reach residual lignin contents of 3.4 to 6.8% by weight, corresponding to kappa numbers of 20 to 40.

A further drop in lignin content either was not desired or was obtained by means of using conventional chlorine-containing bleaching chemicals.

In another process for wood pulping with acetic acid, as disclosed in DE 3,445,132 A1, the pulping solution contains, besides concentrated acetic acid, also minor proportions of a mineral acid, e.g. hydrochloric acid, used as a catalyst. Furthermore, an extraction with dilute aqueous sodium hydroxide solution has been disclosed; this would require a technically expensive alkali recovery. Furthermore, the continuous percolation of the wood as provided, for example, in DE 3,445,132 A1 is accompanied by high acetic acid circulations, a weight ratio of wood to acid solvent of about 1 to 20 being typical.

In the process according to DE 3,445,132 A1, acetic acid is utilized in the boiling stage for the digestion of comminuted wood or of annuals as the starting material, as well as in a subsequent bleaching stage in the presence of hydrogen peroxide.

However, ozone has also been employed successfully as a bleaching agent in acetic acid, as described in EP-A-0,325,891.

On the one hand, the catalytically active amounts of mineral acids can hardly at all be recovered from the resultant wastewaters of, the dissolved wood decomposition products. On the other hand, these mineral acids are volatile, e.g. hydrogen chloride or hydrogen bromide, leading, inter alia, to odor problems. The salts formed from the inorganic components initially present in the pulping material or produced in case of an optional neutralization with dilute aqueous sodium hydroxide solutions would increase the burden on the wastewater and, on account of the halogen content, would restrict utilization and/or waste removal of the separated lignin. Furthermore, as is known, the presence of hydrogen halides in the aqueous phase is accompanied with considerable corrosion problems in connection with the container or processing materials.

These deficiencies have proved to be impediments for the large-scale industrial conversion of the process according to DE 3,445,132 A1 or EP-A-0,325,891.

Moreover, these processes are characterized by high consumptions of bleaching chemicals with comparatively low brightness values in the product. Thus, for softwoods, in the process according to DE 3,445,132 A1, consumptions of hydrogen peroxide can be expected of about 5% by weight based on pulp in absolutely dry state (hereinafter designated as "atro"), with a final brightness of 48.6% ISO or, in the process according to EP-A0,325,891, a consumption of about 2.6% by weight of ozone and of 1.0% by weight of hydrogen peroxide can be expected based on atro pulp, with a final brightness of 62% ISO.

SUMMARY OF THE INVENTION

In order to avoid these deficiencies, an object of the present invention is to provide a process for obtaining pulps suitable for paper production or also for the manufacture of products from regenerated or chemically modified cellulose, of the type wherein there is employed, a sequence of process steps permitting complete delignification of the wood in conjunction with a bleaching sequence without the use of chlorine-containing chemicals.

This object has been attained the invention with a process for the delignification of lignocellulose-containing raw materials which utilizes a weight ratio of the raw material to a pulping solution containing aqueous acetic acid of between 0.08:1 to 0.5:1, a water content in the pulping solution of 5–50% by weight, a temperature of between 140° and 230° C. under a pressure of 3 to 30 bar and with a residence time of between 0.5 and 8 hours in a first delignification stage, followed by subsequent extraction or washing, and further characterized by treatment of the thus-obtained acetic acid-moist pulp with the pulping solution in correspondence with the heretofore described composition with an addition of nitric acid at a weight proportion of 0.5 to 5.0% by weight / of the raw material (atro) at a temperature of 60°–140° C. and under a pressure of 1 to 6 bar and a residence time of 0.1 to 6 hours in a second delignification stage, followed by subsequent washing or extraction with water or with the pulping solution, and thereafter with a treatment of the acetic-acid-moist pulp in a consistency range of 3 to 60% by weight in a liquid phase corresponding to the composition of said pulping solution with an ozone-containing gas under a pressure of 1 to 12 bar and at a temperature of 15° to 50° C. with an amount of ozone of 0.1 up to 2.5% by weight / atro weight of raw material in a third delignification stage.

The process according to this invention thus comprises a delignification in two successive primarily liquid phase delignification stages, as well as an ozone gaseous delignification in a third stage, wherein the lignin content of the pulp can be lowered in total to less than 1% by weight. In the process of DE 3,445,132 A1, lignin contents of about 1% by weight are also obtained, it is true, but at the cost of the presence of hydrogen halides and high consumptions of bleaching agent.

As for the state of the art regarding the second boiling or delignification stage, attention is directed to U.S. Pat. No. 2,511,096 according to which, in a process for obtaining cellulose from lignocellulose containing materials, a treatment of the starting material is disclosed with 5 to 20 parts by weight of a mixture of nitric acid and concentrated aqueous acetic acid at a temperature of between 70° and 110° C. The resultant contents of alpha-cellulose range between 92 and 95.8% by weight.

The treatment with the addition of nitric acid, provided according to this invention in the second delignification stage, can also be effected by using, in addition to or in place of nitric acid, nitrogen oxides, expediently together with a suitable carrier gas, or inorganic nitrates. In order to enhance this reaction, gaseous oxygen can be introduced additionally.

Depending on the demands regarding the quality of the desired final product, pulp, one or several bleaching stages can be provided subsequently to the delignification stages included according to this invention, with the use of hydrogen peroxide, peracetic acid solutions, sodium borohydride, or chlorine dioxide (chlorine peroxide).

Apart from or besides the acetic acid contemplated by the invention as the simplest (unsubstituted) representative of a $C_2$-aliphatic monocarboxylic acid, it is also possible to utilize other $C_1$–$C_4$ aliphatic monocarboxylic acids or a mixture thereof, preferably propionic acid, less preferably formic or butyric acid, in the pulping of the cellulose-containing raw materials.

The present three-stage process is advantageously performed so that first the raw materials to be used, having been mechanically chopped or divided into chips, are brought to a desired water content, for example, by gently conducted contact or convection drying steps and are optionally preimpregnated with acetic acid.

Wood or other material which contains lignocellulose and is optionally preimpregnated is combined with the treating solvent or solution consisting of the acetic acid—water mixture wherein the acetic acid proportion in the pulping solution, including the proportion of water contained in the raw material employed, is at least 50% by weight, and is treated at a temperature of between 140° and 230° C., preferably 170° to 200° C., and under an elevated pressure of between 3 and 30 bar, preferably 5 to 12 bar. The reaction times range between 0.5 and 8 hours, preferably between 1 and 4 hours, depending on the temperature employed and the raw materials used.

The weight ratio of the starting material (atro) to the solution during the reaction can be varied between 0.08:1 and 0.5:1, preferably 0.2:1 to 0.33:1. In case of a continuous operation, higher weight proportions of wood to solvent can be utilized. In case fibrous plants are used, this weight ratio can likewise be varied in correspondence with the particular needs.

After the reaction, the chopped fragments or the fibrous plant sections are shredded by application of mechanical energy, e.g. by means of agitators, and freed from soluble wood degradation products by extraction with an aqueous acetic acid solution.

The digested and extracted pulp from the first stage is, in turn, combined with a concentrated aqueous acetic acid—pulping solution and treated with addition of nitric acid at a temperature of between 60° and 140°, preferably 100° to 120° C. and under a pressure of between 1 and 6, preferably 1 to 4 bar. The reaction times are 0.1 to 6, preferably 0.5 to 2 hours.

The acetic acid proportion in the concentrated aqueous acetic acid—pulping solution is to be at least 50% by weight. During the reaction, the weight ratio of pulp to solution is to range between 1:6 and 1:30, preferably between 1:8 and 1:12. The amount of nitric acid added is suitably 0.5–5% by weight atro wood (or lignocellulose-containing material), preferably 1–2% by weight.

After termination of the reaction, the resultant raw pulp is suitably treated with a concentrated aqueous acetic acid solution in order to extract the soluble wood decomposition products.

The extracted pulp obtained from the second stage is subsequently subjected to a further delignification by means of ozone-containing gas with an ozone content in a carrier gas of about 5–10% by weight. This reaction can be performed in consistency ranges of merely 3% by weight solids content up to more than 60% by weight, preferably between 30 and 50% by weight solids content. Depending on the desired consistency range, the pulp is pressed out or further acetic acid solution is added. Normally, the reaction is carried out under a pressure of between 1 and 2 bar, but pressures of 1 to 12 bar can be utilized specifically in the medium consistency range of 8–16% by weight solids content.

The ozone treatment is suitably conducted at a temperature of between 0° and 70° C., preferably 20° to 40° C.

Carrier gases for the ozone are, for example, air, nitrogen, oxygen or other carrier gases. The ozone-containing mixture of gases are produced in commercially available devices. The reaction times are 0.01 to 2 hours, preferably 0.05 to 1 hour.

Depending on the degree of consistency, the ozone transport to the pulp fiber from the gaseous phase takes place by way of diffusion through a liquid film adhering to the fiber or, in case the pulp is suspended in a continuous liquid phase, from the ozone proportion made to dissolve in the liquid phase by suitable distributing means. The type of aftertreatment depends on the desired purpose of usage of the thus-obtained pulp and can consist of additional extraction, bleaching, or also washing in an acidic, neutral or alkaline region. Suitable solvents are water as well as organic liquids.

The process according to the invention operates without halogen-containing additives or bleaching agents and results in pulps having a residual lignin content of below 1.0% by weight even in case of the softwood raw materials which are difficult to delignify.

The three-stage process of this invention will be described in even greater detail with reference to the following example, and the results obtained are summarized in the subsequent table. Moreover, the regulations for determining the characteristic data for the solids content, the kappa number, the brightness, and the strengths are set forth after the table.

EXAMPLE

1st Delignification Stage 250 g (atro) of spruce wood chips having a water content of 32.5% by weight is combined in a 1.6-liter pressurized autoclave with 42.1 g of water and 1,087.5 g of glacial acetic acid. The autoclave is heated for one hour by means of a double jacket with heat transfer fluid, the temperature of which is set at 202° C., until a reaction temperature of 170° C. and a pressure of 9 bar have been obtained. After 180 minutes under constant temperature and pressure conditions, the circulation of the heat transfer fluid is interrupted. The temperature in the autoclave drops, reaching 105° C. after one hour. The thus-pulped chips are removed from the autoclave and separated from the dark-colored acetic acid solution by way of a Buchner funnel. The pulp is washed by fluffing with the aid of an agitator unit three times in 1.5 l of 87% by weight acetic acid at 70° C. and moisture is removed by means of the Buchner funnel. The pulp is freed of additional solvent in a centrifuge.

The product is 370.1 g of acetic acid-moist pulp having a dry content of 35.6% by weight, corresponding to a yield of 52.7% by weight. 10 g atro of pulp is washed with water in order to determine the kappa number.

2nd Delignification Stage 337.1 g of the acetic acid-moist pulp (120 g atro pulp with a dry content of 35.6% by weight) from the first delignification stage is introduced into a 4-liter agitator-equipped vessel with 268.2 g of water, 1,794.8 g of glacial acetic acid and 3.15 ml of 100% nitric acid (density 1.52 g/ml); a reflux condenser is connected to the vessel. The content of the agitator vessel is heated during a period of 30 minutes by way of a double jacket with heat transfer fluid brought to a temperature of 120° C., until the desired reaction temperature of 108° C. has been attained. The temperature is maintained constant for a time of 120 minutes. After a cooling period of 15 minutes, the pulp is withdrawn from the agitator vessel and moisture is removed by way of a Buchner funnel. The pulp is washed in the same way as after the first delignification stage three times with, respectively, 1.5 l of 87% by weight acetic acid.

The product is 306.1 g of acetic acid-moist pulp with a dry content of 36.9% by weight, corresponding to a pulp yield of 49.6% by weight, based on atro wood. 10 g atro pulp is washed with water in order to determine the kappa number.

3rd Delignification Stage 216.8 g of acetic acid-moist pulp (80 g atro pulp with a dry content of 36.9% by weight) from the second delignification stage is introduced into a 4-liter glass flask and connected to a rotary evaporator adapted for ozone bleaching. The rotating glass flask of the evaporator is maintained in a water bath regulated to a temperature of 20° C.

The ozone is produced in a commercially available generator from pure oxygen. The concentration is 105 g of ozone/M3 of the gas mixture of oxygen and ozone under normal conditions of 0° C. and 1013 mbar.

During a time period of 7 minutes and 37 seconds, 7.62 l of the ozone/oxygen mixture is fed to the slowly rotating flask. The gases exiting from the round flask are introduced into an acidic potassium iodide solution, and 0.05 g of unconsumed ozone is determined by titration with sodium thiosulfate and starch as the indicator. The pulp, after termination of the reaction, is washed exhaustively with water and freed of splinters in a laboratory screener (slot width 0.15 mm).

The product is 226.2 g of moist pulp, corresponding to a pulp yield of 48.1% by weight per atro wood. The dry content thus amounts to 34.3% by weight. The kappa number is determined.

Final Bleaching Stage 174.9 g of the moist pulp (60 g atro pulp with a dry content of 34.3% by weight) from the third delignification stage is thoroughly stirred with 385.2 g of water, 40 ml of 1-molar sodium carbonate solution and 0.65 ml of 40% peracetic acid solution (PS-40, Peroxidchemie Gmbh). The moist pulp is introduced into a polyethylene bag and dipped for one hour into a water bath preheated to 70° C. The pulp is then thoroughly washed with water and dewatered in a centrifuge.

The product is 155.4 g of moist pulp with a dry content of 37.4% by weight, corresponding to a yield of 46.6% by weight; this pulp is investigated with respect to its optical and mechanical properties and the results are given in the following table.

| Delignification Stage | Substance Data | | Results |
|---|---|---|---|
| 1 | kappa number | | 28.2 |
| | yield (% by wt.) | | 52.7 |
| 2 | kappa number | | 3.6 |
| | yield (% by wt.) | | 49.6 |
| 3 | kappa number | | <1.0 |
| | yield (% by wt.) | | 48.1 |
| Final Bleaching Stage | brightness (% ISO) | | 81.7 |
| | yield (% by wt.) | | 46.6 |
| grinding fineness (°SR)* | 15 | 36 | 46 |
| length at break (m) | 8730 | 11250 | 12690 |
| bursting area ($m^2$) | 55.7 | 73.1 | 77.9 |
| tear strength (cN) | 84.4 | 76.0 | 65.9 |

*Schopper-Riegler

The regulations set forth below were used, inter alia, for determining the above-indicated parameters as well as substance data:

Solids content according to Zellcheming IV/42/62

Kappa number according to Zellcheming IV/37/80

Brightness according to Zellcheming V/19/63

Strengths according to Zellcheming V/4/61, V/5/60, V/8/76, V/7/61, V/11/57, V/3/62, V/12/57.

It will be appreciated that the lignocellulose-containing raw materials can also be subjected to treatment (impregnation) with acetic acid vapor which will also degas (vent) the feedstock.

What is claimed is:

1. A process for the delignification of lignocellulose-containing raw materials utilizing in a first stage a weight ratio of the lignocellulose-containing raw material to a pulping solution containing aqueous monocarboxylic acid of between 0.08:1 to 0.5:1, with a water content in the pulping solution of 5 to 50% by weight, a temperature of between 140° and 230° C. under a pressure of 3 to 30 bar and with a residence time of between 0.5 and 8 hours, followed by a subsequent extraction or washing treatment, said process being further characterized by treatment of the thus-obtained monocarboxylic acid-moist pulp with a pulping solution having a composition corresponding to the pulping solution used in the first stage, with addition of nitric acid at a weight proportion of 0.5 to 5.0% by weight / atro of the raw material at a temperature of 60° to 140° C. and under a pressure of 1 to 6 bar and a residence time of 0.1 to 6 hours, and subsequent washing or extraction with water or with the pulping solution in a second stage and thereafter in a third stage effecting treatment of the resulting monocarboxylic acid-moist pulp in a consistency range of 3 to 60% by weight in a liquid phase corresponding to the composition of the pulping solution of the first stage with an ozone-containing gas under a pressure of 1 to 12 bar and at a temperature of 15° to 50° C. with an amount of ozone of 0.1 up to 2.5% by weight based on the atro weight of the raw material to produce a pulp with a lignin content of less than 1% by weight; said monocarboxylic acid comprising a $C_1$–$C_4$ aliphatic monocarboxylic acid or a mixture thereof.

2. A process according to claim 1, further characterized by using, in addition to or in place of the nitric acid in the second stage, nitrogen oxides or inorganic nitrates.

3. A process according to claim 1 or 2, characterized by additionally using gaseous oxygen or oxygen-containing gases for enhancing the reaction with the nitric acid, of the nitrogen oxides or inorganic nitrates.

4. A process according to claim 1, characterized in that, after the third stage, one or several bleaching stages follow in any desired sequence and combination, with the use of hydrogen peroxide, peracetic acid solutions, sodium borohydride or chlorine dioxide.

5. A process according to claim 1, characterized in that the utilized lignocellulose-containing raw material is subjected to predrying or also to preimpregnation with the monocarboxylic.

6. A process according to claim 1, characterized by performing first of all an acetic acid vaporization step in order to degasify the raw materials.

7. A process according to claim 1, characterized by using, as the pulping solution in the first stage an aqueous solution of acetic acid, wherein the acetic acid proportion is at least 50% by weight.

* * * * *